US005943791A

United States Patent [19]

Pavelescu et al.

[11] Patent Number: 5,943,791

[45] Date of Patent: Aug. 31, 1999

[54] WATERPROOF SHOE STRUCTURE WITH ADHESIVELY SECURED SOLE

[75] Inventors: Liviu Mihai Pavelescu, Wuppertal; Manfred Günter Haderlein, Hann, both of Germany

[73] Assignee: Akzo Nobel NV, Arnhem, Netherlands

[21] Appl. No.: 08/945,105

[22] PCT Filed: May 31, 1996

[86] PCT No.: PCT/EP96/02361

§ 371 Date: Dec. 2, 1997

§ 102(e) Date: Dec. 2, 1997

[87] PCT Pub. No.: WO96/41548

PCT Pub. Date: Dec. 27, 1996

[30] Foreign Application Priority Data

Jun. 9, 1995 [DE] Germany ..... 195 21 107
Mar. 2, 1996 [DE] Germany ..... 196 08 139

[51] Int. Cl.[6] ..... A43B 13/28; A43B 7/12

[52] U.S. Cl. ..... 36/14; 36/16; 36/17 R; 36/19.5

[58] Field of Search ..... 36/12, 14, 16, 36/17 R, 17 PW, 19.5, 21

[56] References Cited

U.S. PATENT DOCUMENTS

| | | | |
|---|---|---|---|
| 1,592,751 | 7/1926 | Azzara | 36/16 |
| 1,690,737 | 11/1928 | Loewenbach | 36/16 |
| 2,083,938 | 6/1937 | Belyea | 36/16 |
| 2,189,953 | 2/1940 | Hadaway | 36/16 |
| 2,605,559 | 8/1952 | Vail | 36/14 |
| 3,046,679 | 7/1962 | Maertans et al. | 36/12 |
| 4,819,345 | 4/1989 | Mulcahy et al. | 36/17 R |
| 5,146,697 | 9/1992 | Weiss | 36/12 |
| 5,285,546 | 2/1994 | Haimerl | 36/12 |
| 5,426,869 | 6/1995 | Gore et al. | 36/12 |
| 5,678,326 | 10/1997 | Pavelescu | 36/14 |
| 5,689,903 | 11/1997 | Aumann | 36/12 |
| 5,711,093 | 1/1998 | Aumann | 36/12 |

*Primary Examiner*—Paul T. Sewell
*Assistant Examiner*—Anthony Stashick
*Attorney, Agent, or Firm*—Oliff & Berridge, PLC

[57] ABSTRACT

A shoe structure which includes at least part of a shoe and consists of: an upper, a first insole, a second insole and an outsole. The upper includes at least one outer layer and lining. The lining lines the inside of the outer layer and includes a waterproof and water-vapour permeable functional layer. The first insole closes the underside of the inner area of the shoe structure. The second insole and the outsole are bonded whereby the lining extends further downwards than the outer layer by the length of a lower end area. The lower end area of the lining is turned back to the inside and positioned against the second insole. The second insole has an outer edge around its periphery. The outer edge has a contour corresponding to the contour of the outer layer and joined to the lower end area of the outer layer. The shoe structure includes a second insole cut out to form an outer edge around its periphery and an inner edge around its periphery thus forming a strip between the outer edge and the inner edge. The lower end area of the lining insole and a second section which projects inwards beyond the inner edge of the second insole. The second section of the lower end area of the lining which is turned back is bonded in a waterproof manner to the first insole.

15 Claims, 5 Drawing Sheets

WATERPROOF SHOE STRUCTURE WITH ADHESIVELY SECURED SOLE

BACKGROUND OF THE INVENTION

1. Field of the Invention

The invention relates to a shoe structure, which is at least part of a shoe and consists of: an upper, comprising at least one outer layer and a lining, which lines the inside of the outer layer and includes a waterproof and water-vapour permeable functional layer; a first insole which closes the underside of the inner area of the shoe structure; a second insole and an outsole which is bonded to the second insole, whereby the lower end area is turned back to the inside and positioned against the second insole and bonded to it in a watertight manner, and whereby the second insole has an outer edge around its periphery, the outer edge having a contour corresponding to the contour of the lower end area of the outer layer and joined to the lower end area of the outer layer.

2. Description of the Related Art

A cement-lasted shoe structure of this kind is already known from DE-OS 40 07 962. In the shoe structure described in that publication, it is a prerequisite that the second insole itself must be waterproofed, in that it also includes a waterproof and water-vapour permeable layer on its side which faces the lining, and that the lining has the waterproof, water-vapour permeable functional layer on its side which faces the outer layer. It is not possible in practice to use the known construction in other types of shoe, for example in a Strobel shoe structure (shoe structure in which the second insole is sewn to the outer layer with a sewing machine manufactured by Strobel) or a flex construction shoe structure (the outer layer is turned back to the outside in the lower area and sewn to an insole in the turned-back area).

In the embodiment described in DE-OS 40 07 962, it is not possible when bonding the second insole to the functional layer of the lining to guarantee that the adhesive will form a waterproof connection over the entire surface between the lining and second insole. For this reason, it is readily possible for water to penetrate between the lining and the second insole. Also, the functional layer is heavily stressed when the shoe is worn, which often causes cracks to form in the functional layer or causes the adhesive in the connecting area between the functional layer and second insole to break open, allowing water to penetrate unhindered to the inner area of the shoe.

In an attempt to protect the waterproof, water-vapour permeable functional layer from heavy mechanical stress, it has become common practice to reinforce this functional layer from the outside with a textile material. When functional layers of this kind are used, it is almost impossible to form a waterproof connection between the functional layer and the second insole, because it cannot be guaranteed that the adhesive will penetrate fully the textile reinforcing material which is now positioned between the functional layer and the second insole. Consequently, channels through which water is able to penetrate into the inner area of the shoe structure are already formed during production of the shoe structure. Even if the formation of larger channels can be avoided, microchannels form in the connection area between the lining and the second insole, which are saturated by water drawn in by capillary action.

For this reason, it has become increasingly common in the production of shoe structures with good breathing properties, which are nevertheless waterproof and which contain a waterproof, water-vapour permeable functional layer, to use an injection moulded outsole, since apparently fewer problems related to water tightness occur when the outsole material is injection moulded. Also, this shoe structure design can be manufactured more economically.

SUMMARY OF THE INVENTION

The object of the present invention is to construct a shoe structure of the type initially described with a bonded outsole which at least has better watertightness properties than the shoe structure of the prior art with a bonded sole. A further object of the present invention is to make available a shoe structure with a bonded outsole which guarantees improved watertightness, irrespective of its design.

BRIEF DESCRIPTION OF THE DRAWINGS

The shoe structure of the invention is clarified further in the following illustrations.

Figure 1:
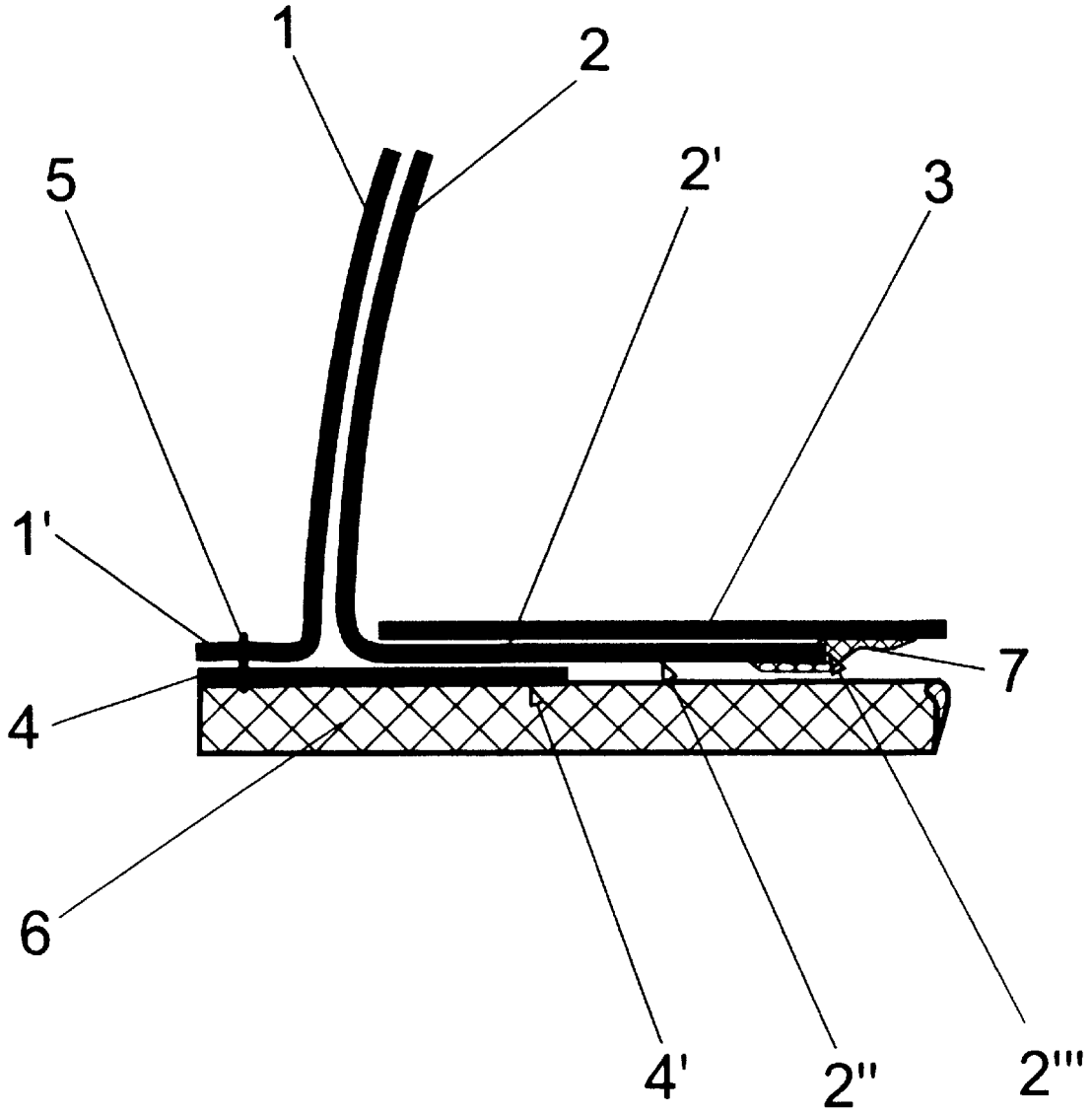
FIG. 1 is a partial section through a shoe structure of the invention.

The solution to these problems is a shoe structure which comprises at least part of a shoe and consists of: an upper, comprising at least one outer layer and a lining, which lines the inside of the outer layer and includes a waterproof and water-vapour permeable functional layer; a first insole which closes the underside of the inner area of the shoe structure; a second insole and an outsole which is bonded to the second insole, whereby the lower end area of the lining is turned back to the inside and positioned against the second insole and bonded to it in a watertight manner, and whereby the second insole has an outer edge around its periphery, the outer edge of the second insole having a contour corresponding to the contour of the lower end area of the outer layer and joined to the lower end area of the outer layer, the shoe structure being characterised in that the second insole is cut out to form an inner edge around its periphery thus forming a strip between the outer edge and the inner edge, in that the lining extends further downwards than the outer layer by the length of a lower end area, in that the lower end area of the lining which is turned back has a first section which lies on the second insole and a second section which projects inwards beyond the inner edge of the second insole, and in that at least the second section of the lower end area of the lining which is turned back is bonded in a waterproof manner to the first insole.

Cutting out the insole and positioning the second section of the lower end area of the lining which is turned back so that it projects, makes it possible to check the waterproof connection which is made with the first insole. During this process, the waterproof connection between the first section of the lower end area of the lining which is turned back and the second insole should preferably be made using an adhesive.

The shoe structure of the invention is characterised in particular by the waterproof connection between the second section of the lower end area of the lining which is turned back and the first insole being formed by a sealing compound which is applied from the outsole side.

In cases where a textile reinforcing material is used on the functional layer, even if it is not possible to saturate the textile reinforcing material completely with adhesive, a waterproof connection can still be formed between the first insole and the functional layer, because the functional layer, which is generally laminated between two flat textile structures, is freely accessible via the inner edge (cut edge) during production of the shoe structure, and it is then simple to coat this inner edge completely with sealing compound, whereby this sealing compound also forms the connection with the first insole. Because a good contact can then be achieved as well at the cut edge of the lining with the functional layer which is arranged between two flat textile structures, since the cut edge is not covered by these flat textile structures, a watertight connection is achieved in a simple manner between the functional layer and the first insole.

It has been found particularly advantageous if the sealing compound used in this process is an adhesive. The adhesives commonly used in the manufacture of shoes are ideally suited for this purpose. These adhesives are characterised by good strength properties, so that applying a coat of adhesive over the point where the second section of the lower end area of the lining which is turned back meets the first insole is in practice sufficient to form a waterproof connection of an adequate strength between the waterproof, water-vapour permeable functional layer and the first insole. If necessary, the strength of the layer of adhesive can be increased by adding threads, in particular flat textile structures such as nonwovens, woven fabrics or knitted fabrics, whereby the threads or flat textile structure should preferably be made of monofilaments.

In order to increase the strength of the waterproof connection between the second section of the lower end area of the lining which is turned back and the first insole, it has also been found advantageous to make this connection with a strip of adhesive tape applied from the outsole side. Strips of adhesive tape which are coated with a hot-melt adhesive, for example on a polyurethane basis, are ideally suited for this purpose. These are also easy to iron onto the areas designed for their application.

In the shoe structure of the present invention, it is sufficient for the first insole to be positioned within the end area of the lining which is turned back and at the same level as the end area of the lining which is turned back, and for any gap formed between the end area of the lining which is turned back and the outer edge of the first insole to be filled and covered by the sealing compound. When the sealing compound is applied, the sealing compound penetrates into the gap between the lining and the first insole, which also guarantees here that the cut edge of the end area of the lining which is turned back and the outer edge of the insole are securely embedded in the sealing compound, forming a good seal. In order to improve the strength of the sealing compound which fills and covers the gap, it has been found particularly advantageous for the first insole to be sewn to the second section of the lower end area of the lining, preferably with a Strobel seam. The use of monofilaments is also recommended for this seam.

It has been found particularly advantageous in the shoe structure of the present invention for the first insole to lie on the end area of the lining which is turned back, and to cover the first and second sections. This makes it particularly easy to guarantee the formation of a watertight seal by the sealing compound between the insole and lining.

It is advantageous if a filler layer is positioned between the first insole and the outsole, which fills the space between the first insole and the outsole, and which has an outer edge which runs within the inner edge of the second insole and covers the point where the second section of the lower end area of the lining which is turned back meets the first insole. This filler layer can be produced easily from the same material as the first or second insole. The filler layer should, however, preferably be made of a waterproof synthetic material.

It has been found advantageous here for the filler layer to be bonded in a waterproof manner to the second section of the lower end area of the lining which is turned back hand/or to the first insole. In this way, the filler layer does not only improve the wearing comfort of the shoe, but also increases its watertightness, since it supports the sealed connection between the second section of the lower end area of the lining which is turned back and the first insole and, in the event that the filler layer is joined to the second section and the first insole, also contributes to the strength of the connection point. It has also been found advantageous here if the waterproof connection between the second section of the lower end area of the lining which is turned back or the first insole and the filler layer is made by gluing.

In the shoe structure of the present invention it can be advantageous to join together the adjacent sections of the strip of the second insole with a retainer, at least in the ankle area, which can stabilise the outer shape of the outer layer. In the simplest case, they can be joined together using threads, in particular monofilaments. The retainer can, however, also be a woven or knitted fabric or a nonwoven. The use of monofilaments has also proven successful here. The retainer should preferably be formed so that in the event that the outsole is bonded to the first insole, possibly via the filler layer, the adhesive which bonds the outsole in place can easily penetrate the retainer. Woven or knitted fabrics with an open structure have proven ideal for this purpose.

The shoe structure of the invention can be used both in cement-lasted shoes and in shoes in which the second insole is sewn to the outer layer (with a Strobel seam). The shoe structure of the invention has, however, been found particularly suitable for flex construction shoes, in which the lower end area of the outer layer is turned back to the outside and the part of the outer layer which is turned back is at least approximately parallel to the direction in which the sole extends and is sewn to the second insole. These shoes are characterised by a high degree of wearing comfort because they are particularly flexible when the foot rolls forwards as the wearer walks. These shoes, which are considered very comfortable, have not, however, previously had a good record for watertightness. This disadvantage can, however, be effectively minimised with the shoe structure of the invention, and in most cases, entirely avoided.

In the illustrations, the upper is formed from an outer layer 1 and a lining 2, which lines the inside of the outer layer. The lining 2 is made up of the actual lining material and a waterproof and water-vapour permeable functional layer (not illustrated). The functional layer may possibly have a further textile layer on its side which faces away from the lining layer. The textile layers are usually glued to the functional layer, at least with spots of adhesive, for which reason the entire lining 2 can be designated a laminate.

The illustrations depict a flex construction shoe structure. To form this structure, the lower end area 1' of the outer layer 1 is turned back to the outside, extends in the direction of the sole material and lies on and parallel to the second insole 4, and is sewn to the latter with the seam 5. The lower end area of the lining shown in FIGS. 1 and 3 is turned back to the inside and around a first insole 3. A first section 2' of the lower end area of the lining 2 lies on the second insole 4 and is bonded in a waterproof manner to the second insole 4, which is cut out so that it forms a self-enclosed strip, as can be seen clearly in FIG. 2. A second section 2" of the lower end area of the lining overlaps area 4' of the second insole 4 and ends in the inner edge or cut edge 2'". The second section 2" is bonded in a watertight manner to the first insole 3 by the sealing compound 7, whereby the sealing compound securely encloses the cut edge 2'". For reasons of clarity, the sealing compound 7 is not illustrated in FIG. 2. Bonded to the second insole 4 is an outsole 6, which is not shown in FIG. 2, in order to illustrate more clearly the interior makeup of the shoe structure.

A filler layer 9 is also depicted in FIG. 3, which is glued to the lower section 2" of the lower end area of the lining. The filler layer 9 can also be glued to the first insole 3 in the inner area, that is, in the area which is not covered by the lower end area of the lining 2.

Figure 2:
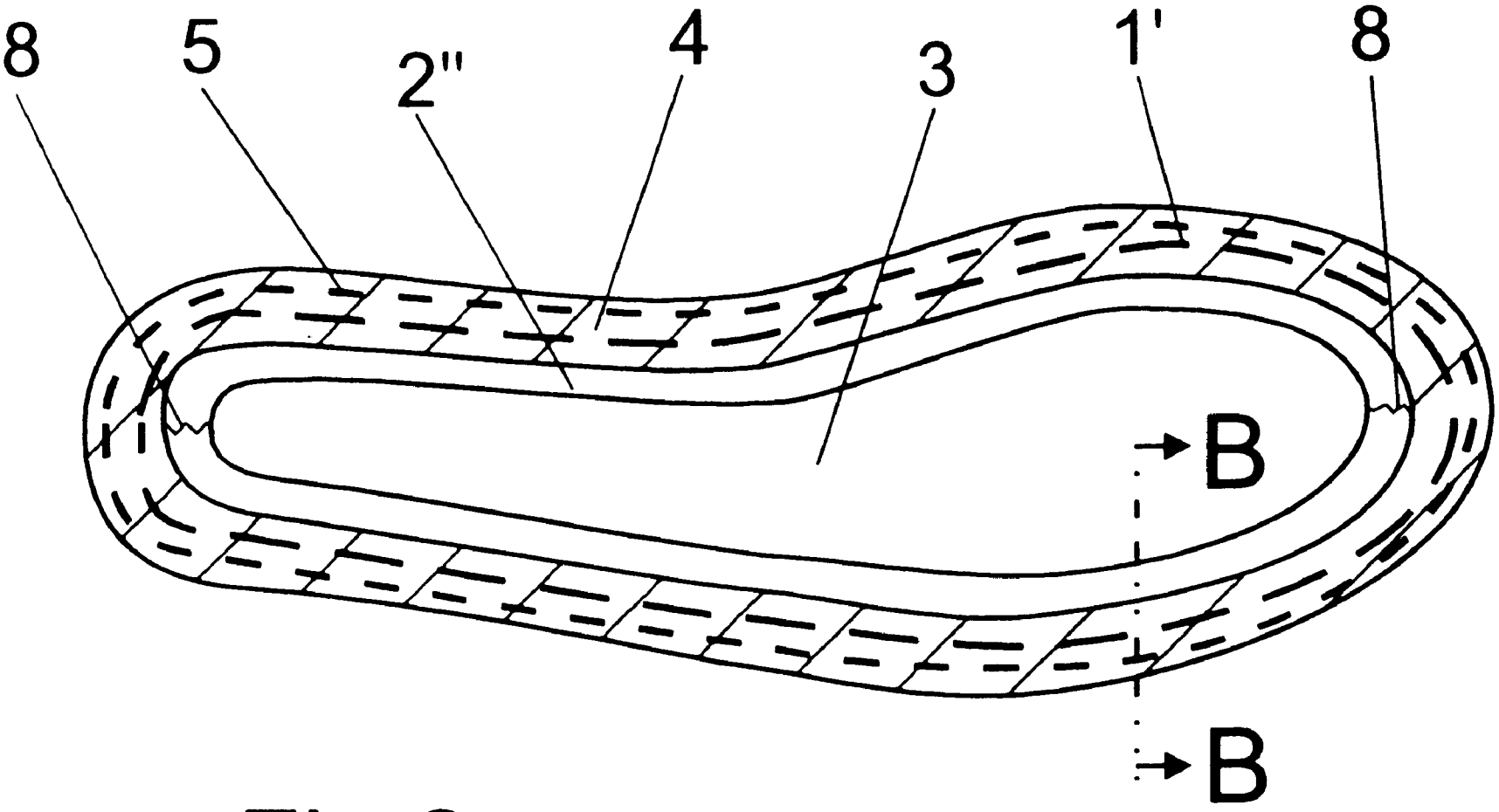
FIG. 2 is a view from below of the shoe structure of the invention shown without the outsole.
Figure 3:
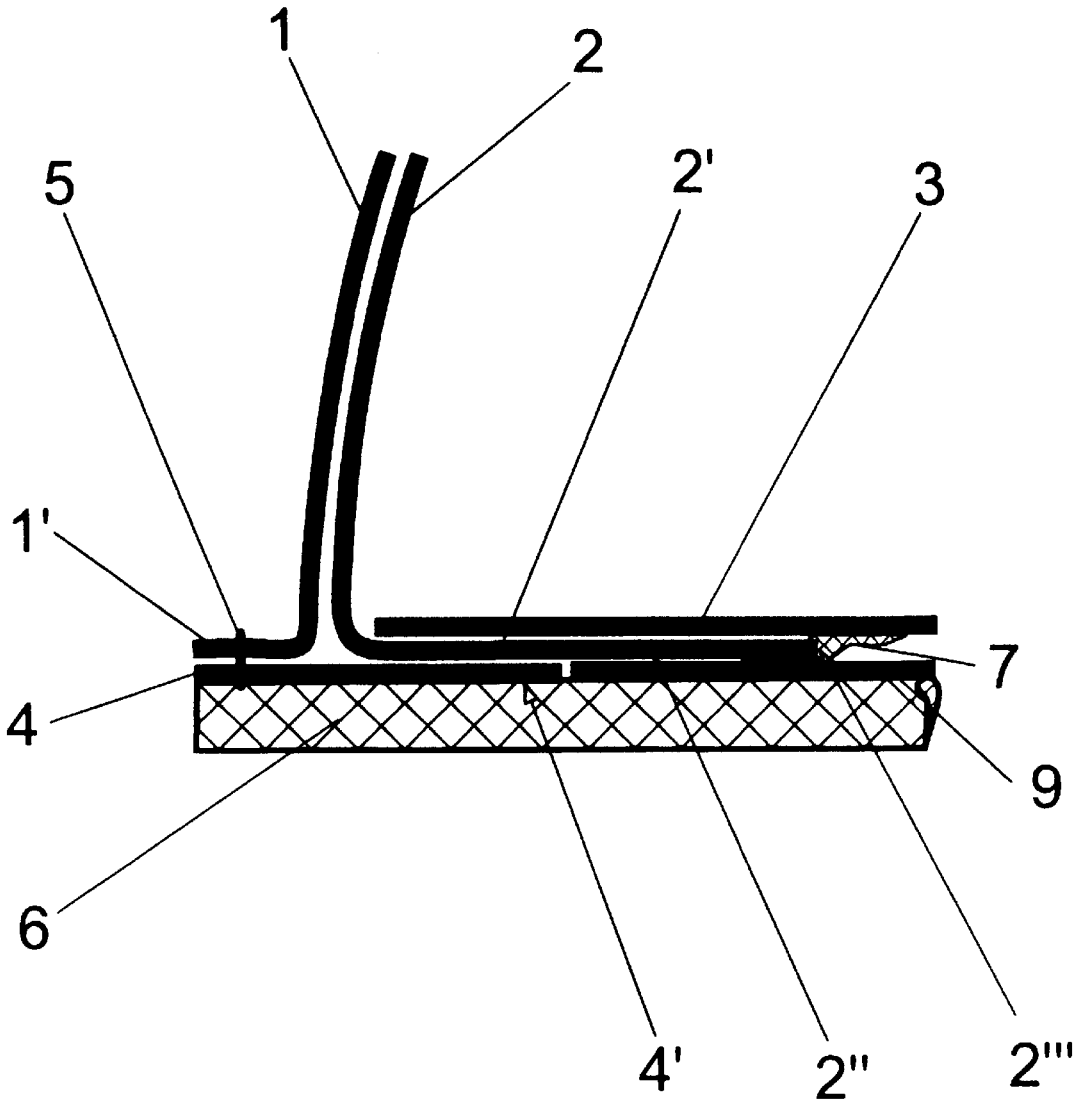
FIG. 3 is a further partial section through a shoe structure of the invention.

It is also evident from FIG. 2 that the lower end area of the lining 2 is cut into in the toe and heel areas and sewn up with a seam 8, in order to prevent creases forming in this area. The seam 8 should preferably be sealed with an adhesive tape. If it is likely that creases may form in other parts of the lower end area (first and second sections 2' and 2") of the lining, the lining can also be cut into and sewn up in these areas, and if necessary sealed with an adhesive tape.

Figure 4:
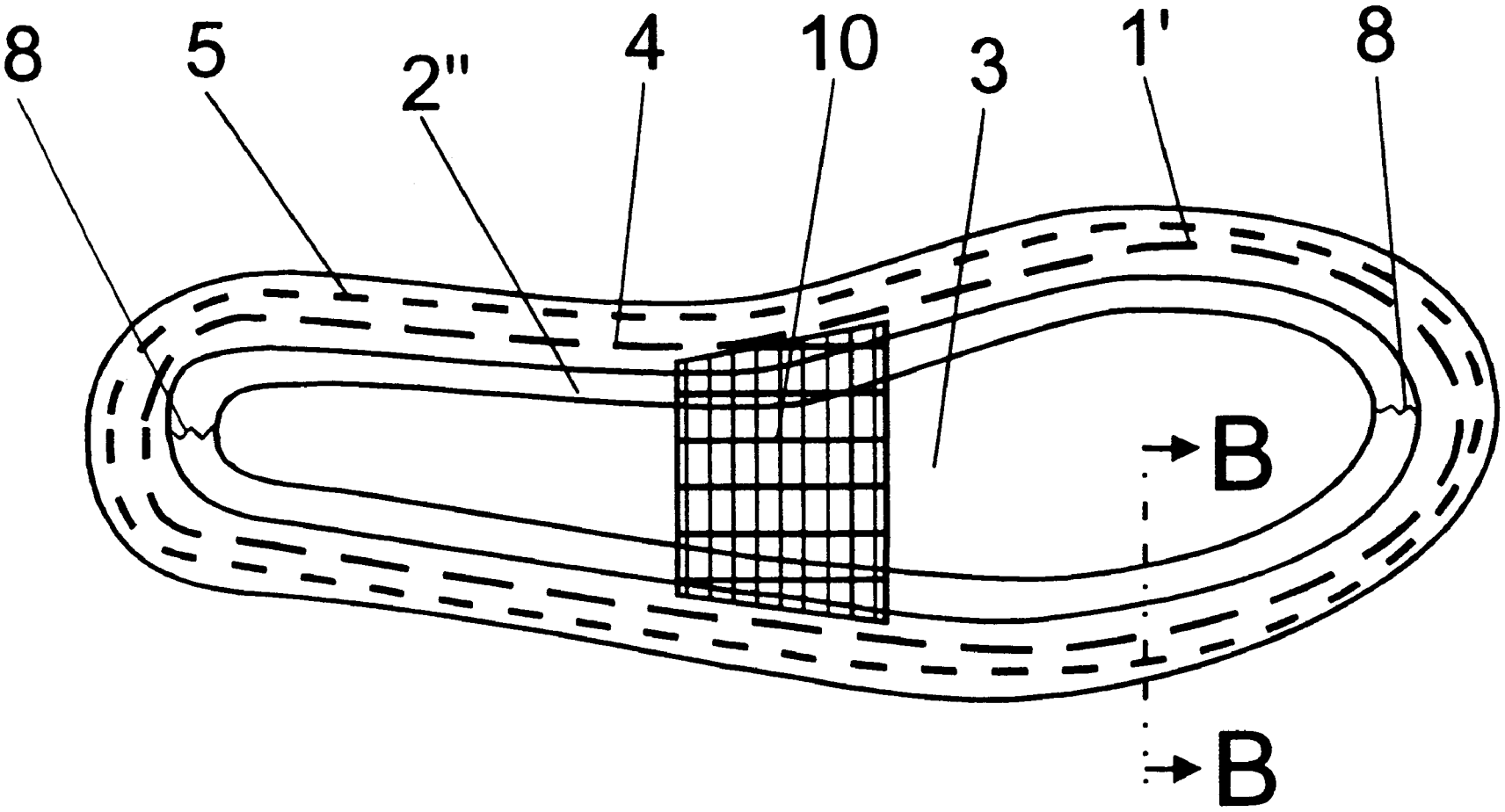
FIG. 4 is a further view from below of a shoe structure of the invention, with a retainer for the second insole, shown without the outsole.

In FIG. 4, the shoe structure depicted in FIG. 2 is reinforced in the ankle area with a lattice or retainer 10, which should preferably be made of monofilaments. This lattice is sewn to the second insole 4 in the area of the inner edge. In this simple manner, the outer shape of the shoe can be stabilised on production of the shoe structure without impairing the bonding of the outsole to the second insole, since this lattice can be easily penetrated by the adhesive. This stabilisation has proven particularly successful in shoe structures with Strobel seams.

Figure 5:
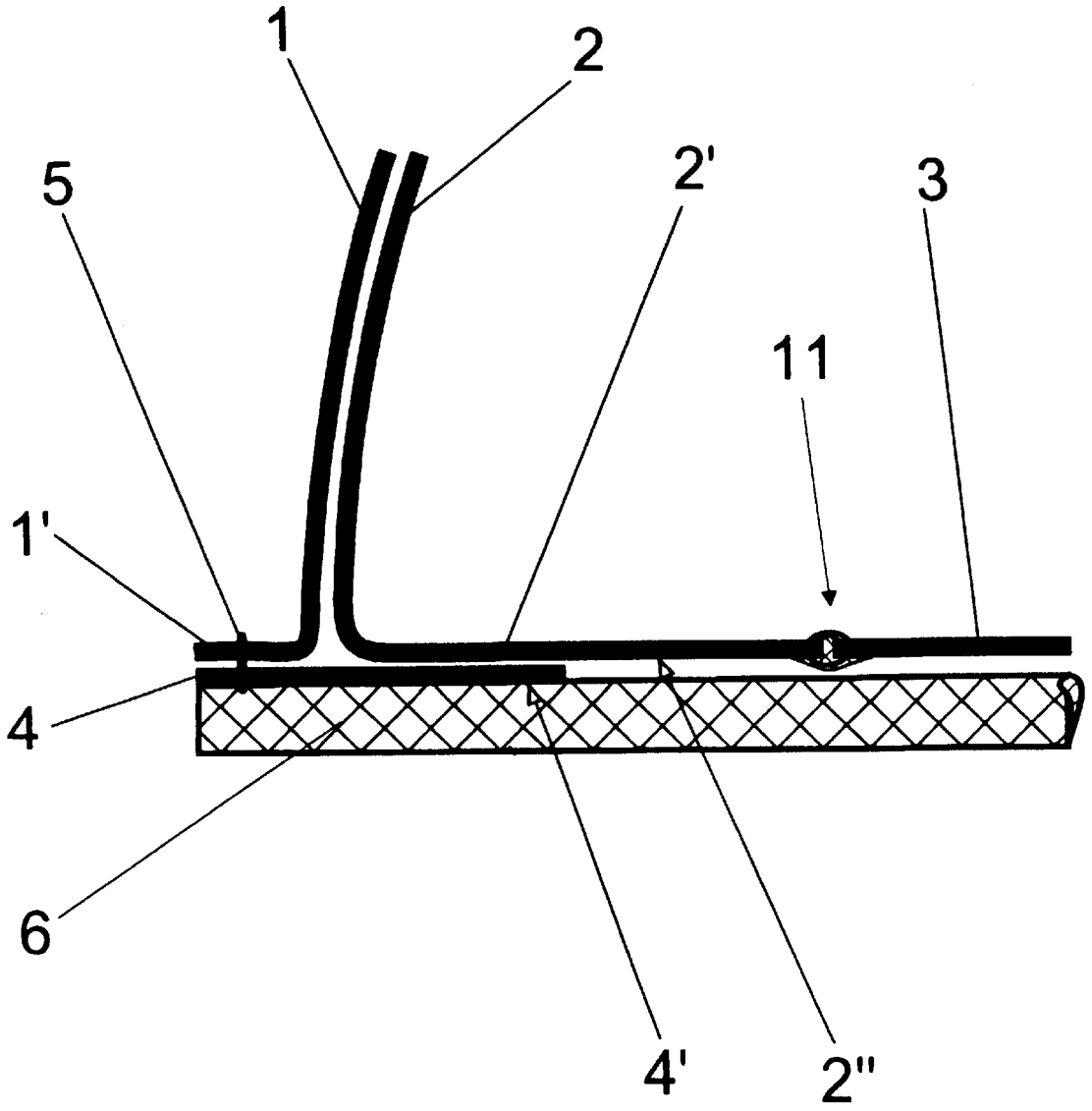
FIG. 5 is a further partial section through a shoe structure of the invention.

FIG. 5 illustrates a further partial section of a shoe structure of the invention. Here, the first insole is positioned inside the end area of the lining which is turned back, and is at the same level as the turned back end area (2' and 2") of the lining 2 on the side towards the foot, so that a level surface is formed in the inner area of the shoe. In area 11, the first insole 3 is sewn with a Strobel seam to the second section 2" of the lower end area of the lining 2 which is turned back. The gap in area 11 is completely filled with sealing compound, whereby the sealing compound covers the gap from below.

Although an entire shoe is generally manufactured using the shoe structure of the invention, it is possible that in some special cases only parts of the shoe are constructed using the shoe structure of the invention, for example only the toe area, the ankle area or the heel area, while the other areas of the shoe are formed with a different shoe structure which is more suitable for these areas. In protective shoes with a steel cap, for example, it is advisable only to form the area without a steel cap in accordance with the shoe structure of the invention.

What is claimed is:

1. A shoe structure which comprises at least part of a shoe and consists of: an upper, comprising at least one outer layer and a lining, which lines the inside of the outer layer and includes a waterproof and water-vapour permeable functional layer; a first insole which closes an underside of an inner area of the shoe structure; a second insole and an outsole which is bonded to the second insole, whereby a lower end area of the lining is turned back to the inside and positioned against the second insole and bonded to it in a waterproof connection, and whereby the second insole has an outer edge around its periphery, the outer edge having a contour corresponding to the contour of the lower end area of the outer layer and joined to the lower end area of the outer layer, wherein the second insole is cut out to form an inner edge around its periphery thus forming a strip between the outer edge and the inner edge, wherein the lower end area of the lining which is turned back has a first section which lies on the second insole and a second section which projects inwards beyond the inner edge of the second insole, and wherein at least the second section of the lower end area of the lining which is turned back is bonded in a waterproof connection to the first insole.

2. A shoe structure in accordance with claim 1, wherein the waterproof connection between the second section of the lower end area of the lining which is turned back and the first insole is formed by a sealing compound which is applied from the outsole side.

3. A shoe structure in accordance with claim 2, wherein the sealing compound is an adhesive.

4. A shoe structure in accordance with claim 1, wherein the waterproof connection between the second section of the lower end area of the lining which is turned back and the first insole is made with a strip of adhesive tape applied from the outsole side.

5. A shoe structure in accordance with claim 1, wherein the first insole is positioned inside the end area of the lining which is turned back, and is at the same level as the turned back end area of the lining, and wherein any gap between the end area of the lining which is turned back and the outer edge of the first insole is completely filled and covered by the sealing compound.

6. A shoe structure in accordance with claim 4, wherein the first insole is sewn to the second section of the lower end area of the lining which is turned back.

7. A shoe structure in accordance with claim 1, wherein the first insole lies on the end area of the lining which is turned back, and covers the first and second sections.

8. A shoe structure in accordance with claim 1, wherein a filler layer is positioned between the first insole and the outsole which fills the space between the first insole and the outsole, and which has an outer edge which runs within the inner edge of the second insole and covers the point where the second section of the lower end area of the lining which is turned back meets the first insole.

9. A shoe structure in accordance with claim 8, wherein the filler layer is bonded in a waterproof manner to the second section of the lower end area of the lining which is turned back.

10. A shoe structure in accordance with claim 8, wherein the filler layer is bonded in a waterproof manner to the first insole.

11. A shoe structure in accordance with claim 9, wherein the waterproof connection between the second section of the lower end area of the lining which is turned back or the first insole and the filler layer is made by gluing.

12. A shoe structure in accordance with claim 1, wherein the adjacent sections of the strip of the second insole are joined together with a retainer, at least in the ankle area.

13. A shoe structure in accordance with claim 12, wherein the retainer is made of monofilaments.

14. A shoe structure in accordance with claim 12, wherein the retainer is a woven fabric, a knitted fabric or a nonwoven fabric.

15. A shoe structure in accordance with claim 1, wherein the shoe structure is manufactured with a flex design, in which the lower end area of the outer layer is turned back to the outside and the part of the outer layer which is turned back is at least approximately parallel to the direction in which the outsole extends and is positioned on the second insole and sewn to the second insole.

* * * * *